United States Patent [19]

Pettus

[11] Patent Number: 4,559,856

[45] Date of Patent: Dec. 24, 1985

[54] FOOD CUTTING DEVICE

[76] Inventor: Milton Pettus, P.O. Box 292, Merritt Island, Fla. 32952

[21] Appl. No.: 504,978

[22] Filed: Jun. 16, 1983

[51] Int. Cl.[4] ..... B26D 7/06

[52] U.S. Cl. ..... 83/431; 30/114; 83/437; 83/630

[58] Field of Search ..... 83/630, 632, 437, 404.3, 83/407, 431, 425, 425.3

[56] References Cited

U.S. PATENT DOCUMENTS

| | | | |
|---|---|---|---|
| 1,276,437 | 8/1918 | Stevenson | 83/630 |
| 2,283,029 | 5/1942 | Bakewell | 83/437 |
| 2,407,924 | 9/1946 | Garfunkel | 83/437 |
| 2,836,212 | 5/1958 | Shaw | 30/114 |

FOREIGN PATENT DOCUMENTS

| | | | |
|---|---|---|---|
| 430115 | 6/1935 | United Kingdom | 83/431 |

*Primary Examiner*—Frank T. Yost
*Assistant Examiner*—Hien H. Phan

[57] ABSTRACT

An apparatus consisting of portable elongated body containing a single centrally located slidable actuator between two cavities for the loading of foodstuff. This actuator connects to a slidable mover located within each cavity, such that application of downward force against the actuator causes both movers to simultaneously push loaded foodstuffs through removable sets of cutting blades, located at opposite ends of the apparatus. These movers, connected with a tension spring, and the actuator return to the load position upon release of the downward force.

1 Claim, 5 Drawing Figures

FOOD CUTTING DEVICE

BACKGROUND OF THE INVENTION

This invention relates to apparatus in the production of fruit pieces for use in the many types of mixed drinks which are served in bars, restaurants, clubs, ships, airlines, homes and etc.

The problem with cutting fruit with a knife and one slice per stroke is it takes a lot of time, energy and can be hazardous to one's appendages (fingers) when in a hurry or tired.

The only items on the market to perform this function are knives which are slow and inconsistent in the size of the finished product.

SUMMARY OF THE INVENTION

The above mentioned disadvantages have been overcome by the present invention which includes a better method of cutting the fruit.

A primary feature of the present invention includes the construction of a set of blades installed in such a way as to produce many pieces for each operation of the handle.

A further feature of the present invention is the construction of the blades so that the cut parts are the same size when cut by the apparatus.

Still another feature of the present invention is the capability, by positioning of blades, to have different shaped parts.

An additional feature of the invention is that one model can cut up two different items of fruit at the same time.

DESCRIPTION OF THE ILLUSTRATED EMBODIMENTS

Figure 1:
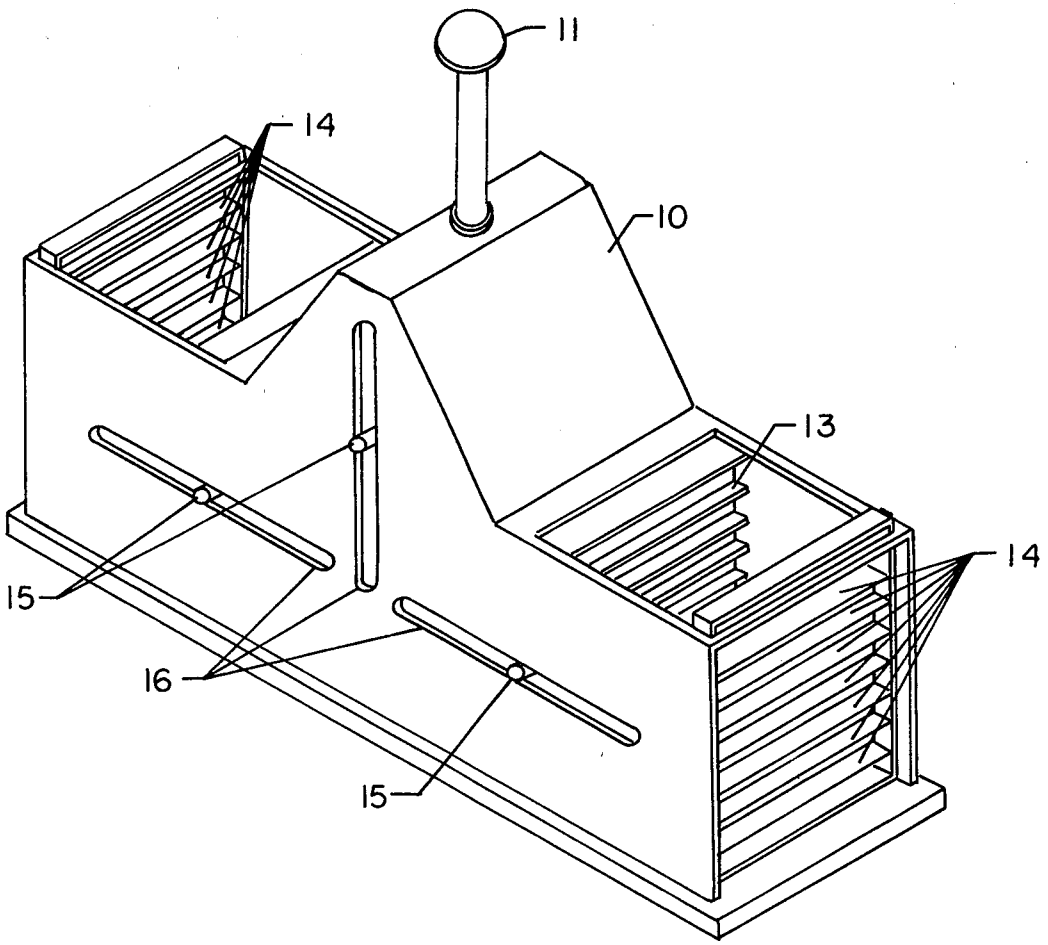
Figure 2:
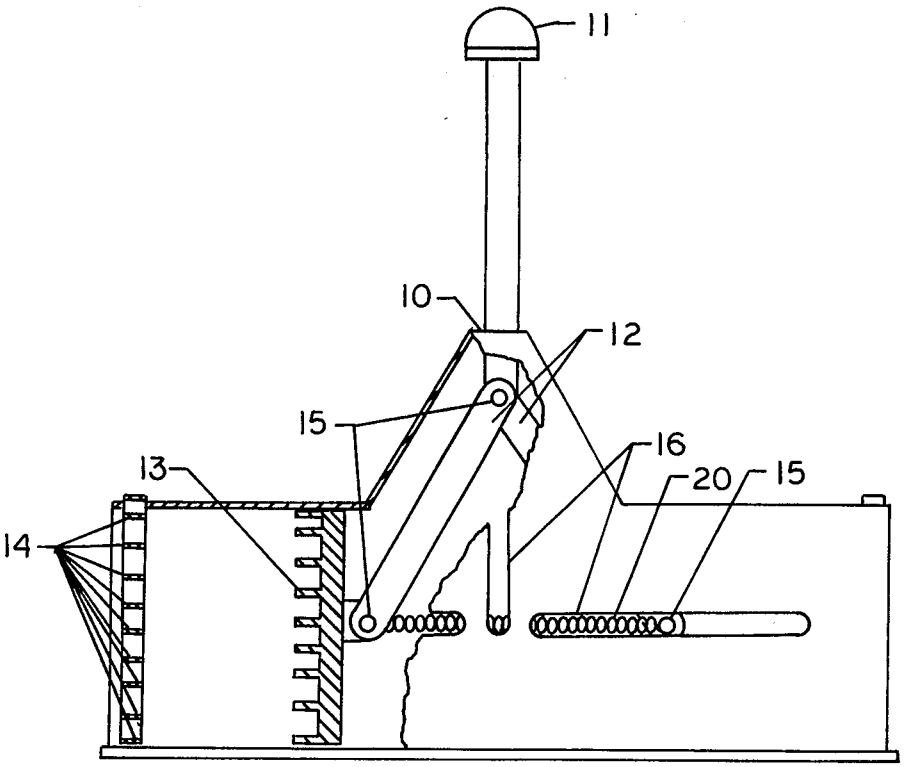

Referring to the drawings, a first embodiment of a dual bartender helper is shown in FIGS. 1–2, which embodiment is constructed in the form of a box with a raised center section and represented by the reference number 10. The bartender helper 10 includes a conventional rectangular housing with a few variations as the two entrances or openings between movers 13 and cutters 14. Supported and mounted at either end or discharge points are the blades or cutters 14 and the movers 13 beyond the entrance openings to move the items (usually fruit) through the cutters 14.

Figure 3:
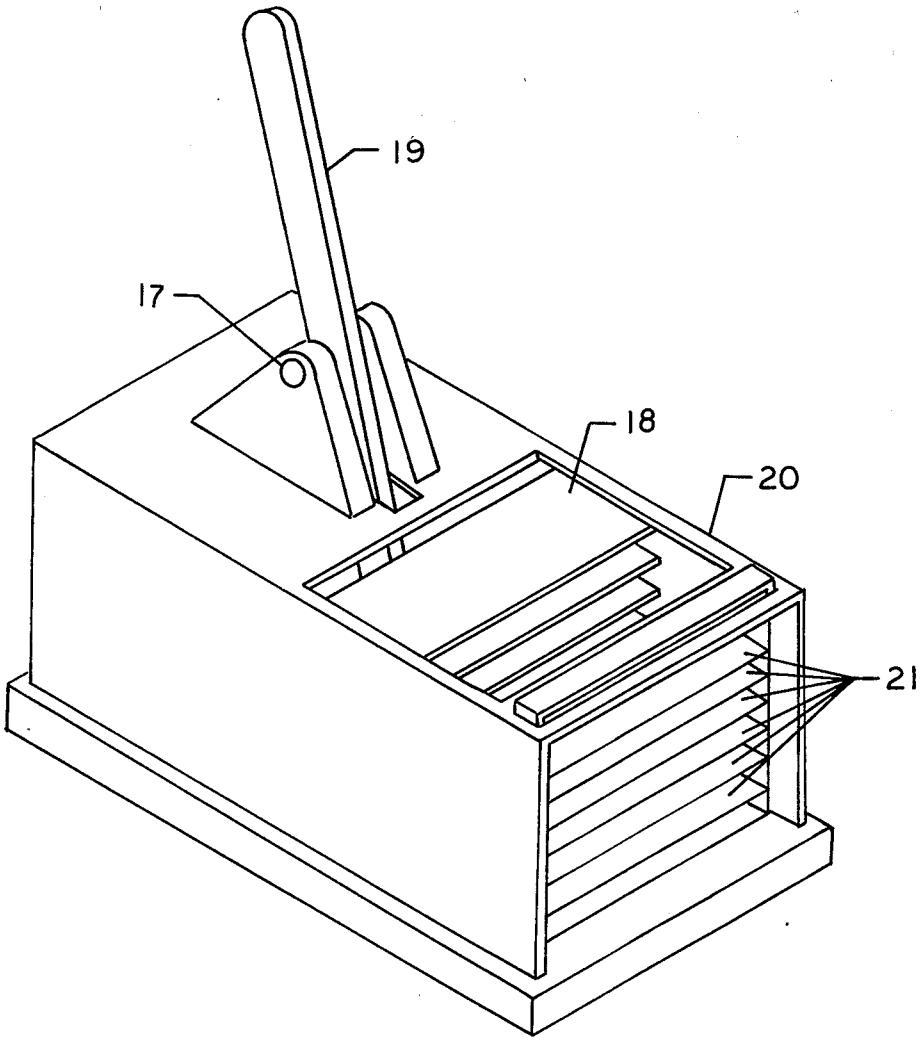
Figure 4:
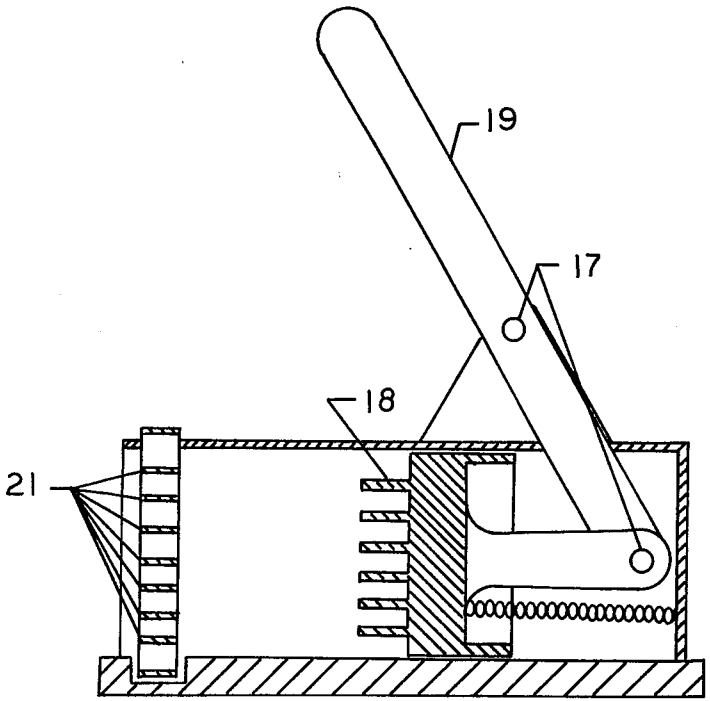

As shown in FIGS. 3–4, the embodiment is a rectangular box with a fulcrum point protruding above. These figures show a perspective view, and a cutaway of a single bartender helper. Item 19 is the operating arm pivoted on pin 17 and transmitting the force thru pin 21 into movers 18 to cause the item to go thru the blades 21.

Figure 5:
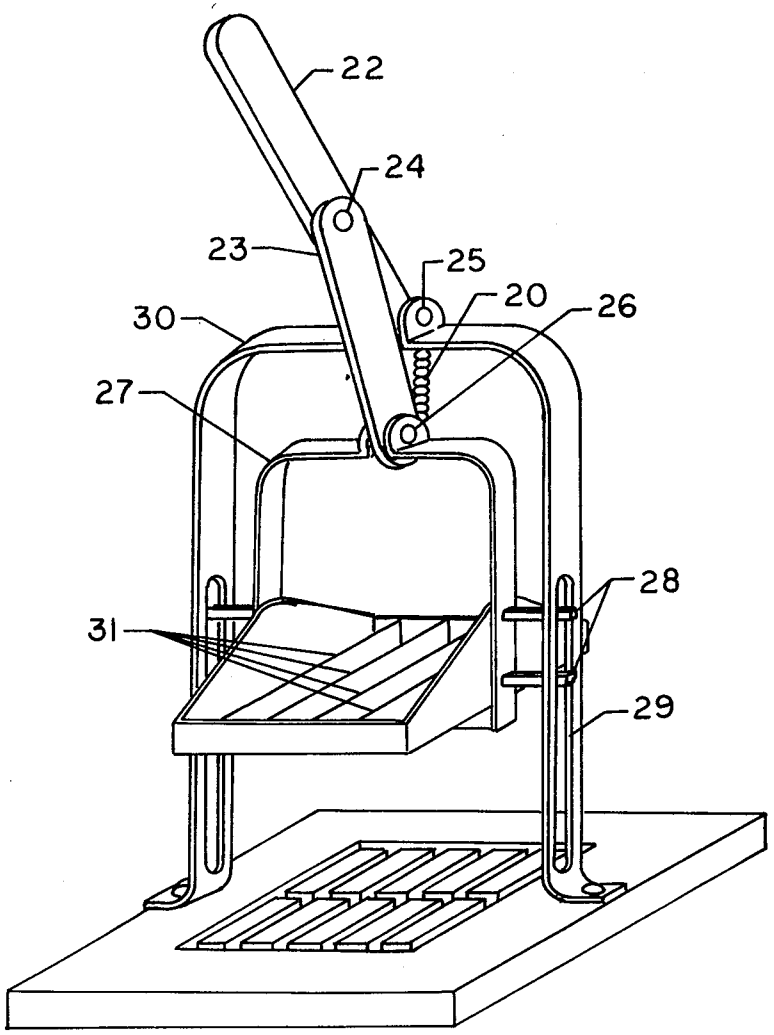

FIG. 5 illustrates another model of a single bartender helper. Item 22 is the operating arm rotating about pin 25 in frame 30 and transmitting the force through pin 24 in arm 22 & 23 into arm 23 to pin 26 in arm 23 and carrier 27 to cause carrier 27 to go down on the item and blades 31 would cut up the item.

OPERATION

In utilizing the bartender helper apparatus embodying the principles of the present invention, the item is placed between movers 13 and blades 14 in FIGS. 1 and 2 and arm 11 is moved down and the item is forced thru blades 14 cutting to the proper size and shape. In FIGS. 1 and 2, one item may be placed in either opening or only one opening. When the vertical force is imposed on arm 11, it is transmitted through pin 15 in arms 11 & 12 into arms 12 and into pins 15 in arms 12 and movers 13 causing movers 13 to move horizontal, moving the item(s) thru blades 14. Upon removing the force from arm 11 it will retract as a result of spring 20 between pins 15 in arms 12 and movers 13.

In FIGS. 3 and 4 during operation the item is placed between mover 18 and blades 21, then lever 19 is either pulled or pushed (depending on position of bartender helper, lever 19 pivoting on pin 17 and transferring the force thru pin 21 into mover 18 forcing the item through blades 21 cutting to desired size and shape. Upon releasing lever 19 it returns to the original position due to the spring 20 between mover 13 and body 20.

FIG. 5 shows another model of a bartender helper that does the same job with the same basic components as previous figures. An item is placed beneath blades 31 and a force applied to lever 22 which pivots on pin 25 at frame 30 and lever 22 and transmitting the force thru pin 24 in lever 22 and bar 23 into bar 23 thru pin 26 in bar 23 and moving frame 27 in stationary support 30 while transferring the force thru frame 27 to blades 31 which cut the item to the size and shape desired. During the operation as the moving frame 27 moves down it is guided by pins 28 in slots 29. Upon removal of force from lever 22 it returns to original position due to spring 20 between frames 27 and 30.

It now becomes apparent that the above described embodiment of a bartender helper is capable of performing the above stated tasks by exerting a minimum amount of energy. It is obvious that those skilled in the art may make modifications in the details of construction without departing from the spirit of the invention, which is to be limited only by the scope of the appended claims.

What is claimed:

1. A cutting apparatus comprising: a housing having an elongated horizontal base with opposite ends; two parallel walls mounted on said base; two blade assemblies comprising a plurality of cutting blades having cutting edges, one blade assembly located at each opposite end of the base; two movers on said base, each mounted between said walls and slidable toward and away from a different opposite end, each mover having a loading position remote from and a cutting position adjacent one of the two blade assemblies; a handle located between the movers and moveable vertically within said housing; two arms, each pivotally mounted at one end to the handle and at the other end to one of the movers such that downward actuation to the handle causes the arms to simultaneously move the movers from the loading position toward the cutting position; spring means for continuously biasing the movers toward the loading position.

* * * * *